US012442268B2

(12) United States Patent
Skeete

(10) Patent No.: US 12,442,268 B2
(45) Date of Patent: Oct. 14, 2025

(54) PACKER BYPASS

(71) Applicant: Tally USA, LLC, Houston, TX (US)

(72) Inventor: Aaron Michael Benjamin Skeete, Katy, TX (US)

(73) Assignee: TALLY USA, LLC, Houston, TX (US)

( * ) Notice: Subject to any disclaimer, the term of this patent is extended or adjusted under 35 U.S.C. 154(b) by 0 days.

(21) Appl. No.: 18/474,767

(22) Filed: Sep. 26, 2023

(65) Prior Publication Data

US 2024/0102352 A1 Mar. 28, 2024

Related U.S. Application Data

(60) Provisional application No. 63/411,000, filed on Sep. 28, 2022.

(51) Int. Cl.
*E21B 33/12* (2006.01)
*E21B 34/06* (2006.01)

(52) U.S. Cl.
CPC ..... *E21B 33/12* (2013.01); *E21B 34/06* (2013.01)

(58) Field of Classification Search
CPC ..... E21B 21/103; E21B 43/12; E21B 43/14; E21B 43/16; E21B 33/1294
See application file for complete search history.

(56) References Cited

U.S. PATENT DOCUMENTS 5,022,427 A * 6/1991 Churchman ..... E21B 43/123 137/155
10,989,012 B2 * 4/2021 Hrabovsky ..... E21B 43/122
2010/0032153 A1 * 2/2010 Phloi-montri ..... E21B 43/122 166/142

* cited by examiner

*Primary Examiner* — Yanick A Akaragwe
(74) *Attorney, Agent, or Firm* — Park, Vaughan, Fleming & Dowler

(57) ABSTRACT

Described herein are embodiments of systems, apparatuses, and methods that include an improved packer bypass assembly. The packer bypass assembly includes a first end and a second end, where a primary bore extends between the first and second end. The packer bypass assembly further includes a bypass bore through which flow may travel separate from that in the primary bore. The bypass bore may include a check valve that only permits flow in one direction. By providing two flow bores that support flow in opposite directions in the same packer bypass assembly, gas injected into an annulus between the casing and the packer bypass assembly can "bypass" the packer assembly and travel to an injection valve situated in the well below the packer.

34 Claims, 5 Drawing Sheets

PACKER BYPASS

PRIORITY CLAIM

This application claims priority to provisional patent application Ser. No. 63/411,000 filed Sep. 28, 2022, which is fully incorporated herein by reference.

BACKGROUND

Technical Field

Embodiments of the subject matter disclosed herein relate to an improved packer bypass and methods of operating and using the same.

Discussion of the Background and Summary of the Invention

Production tubing is deployed into a well to support hydrocarbon recovery. Generally, formation fluid (e.g., hydrocarbons) produced from a formation through which the well extends is received into the production tubing. In some cases, compressed gas (lift gas) is pumped down into the annulus between the well bore (or the casing) and the production tubing. The lift gas is received into the production tubing via the gas-lift valves or around the end of the tubing, along with the formation fluid. Gas-lift valves provided along the length of the tubing string provide an entry point for the lift gas, and the gas assists lightening the fluid gradient and in channeling the formation fluid up through the production tubing and increasing velocity of the hydrocarbons. This process is referred to as "gas lift." The gas-lift valves may be opened depending on relative pressures of the lift gas. A variety of such gas lift processes have been implemented successfully in the industry.

In some gas-lift processes, a packer may be positioned below a gas-lift valve. When set, the packer seals the annulus, but provides a bore there-through that allows communication with the interior of the production tubing. In some cases, formation fluids may be recoverable from below the packer, and thus it is desirable to direct the lift gas to the annulus between this "second" part of the production tubing (sometimes referred to as a "tail pipe").

In order for the lift gas to reach the annulus below the production packer, a packer bypass is necessary. The bypass provides a flow path for the lift gas through the packer, separate from the flow path for the produced fluids proceeding upwards through the packer. However, bypasses are often expensive, may reduce lift gas flow rates, and can be damaged or result in damage to the production tubing, e.g., fluid cuts or erosion in the crossover due to high fluid velocities. The present invention addresses at least some of the drawbacks and shortcomings of these prior art packers.

BRIEF DESCRIPTION OF THE DRAWINGS

The accompanying drawings, which are incorporated herein and constitute a part of the specification, illustrate one or more exemplary embodiments of the present invention. In the drawings.

DETAILED DESCRIPTION

Various features and advantageous details are explained more fully with reference to the non-limiting embodiments that are illustrated in the accompanying drawings and detailed in the following description. Descriptions of well-known starting materials, processing techniques, components, and equipment are omitted so as not to unnecessarily obscure the invention. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended or implied. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

The present invention is directed to an improved bypass packer assembly. Details of the present invention will be appreciated by those skilled in the art by reference to the attached and described drawings. While the drawings collectively seek to illustrate aspects of the invention, the invention is not limited to the details of the drawings themselves. Instead, the scope of the invention is defined by what the details described herein would convey to a person of ordinary skill in the art.

Figure 1:
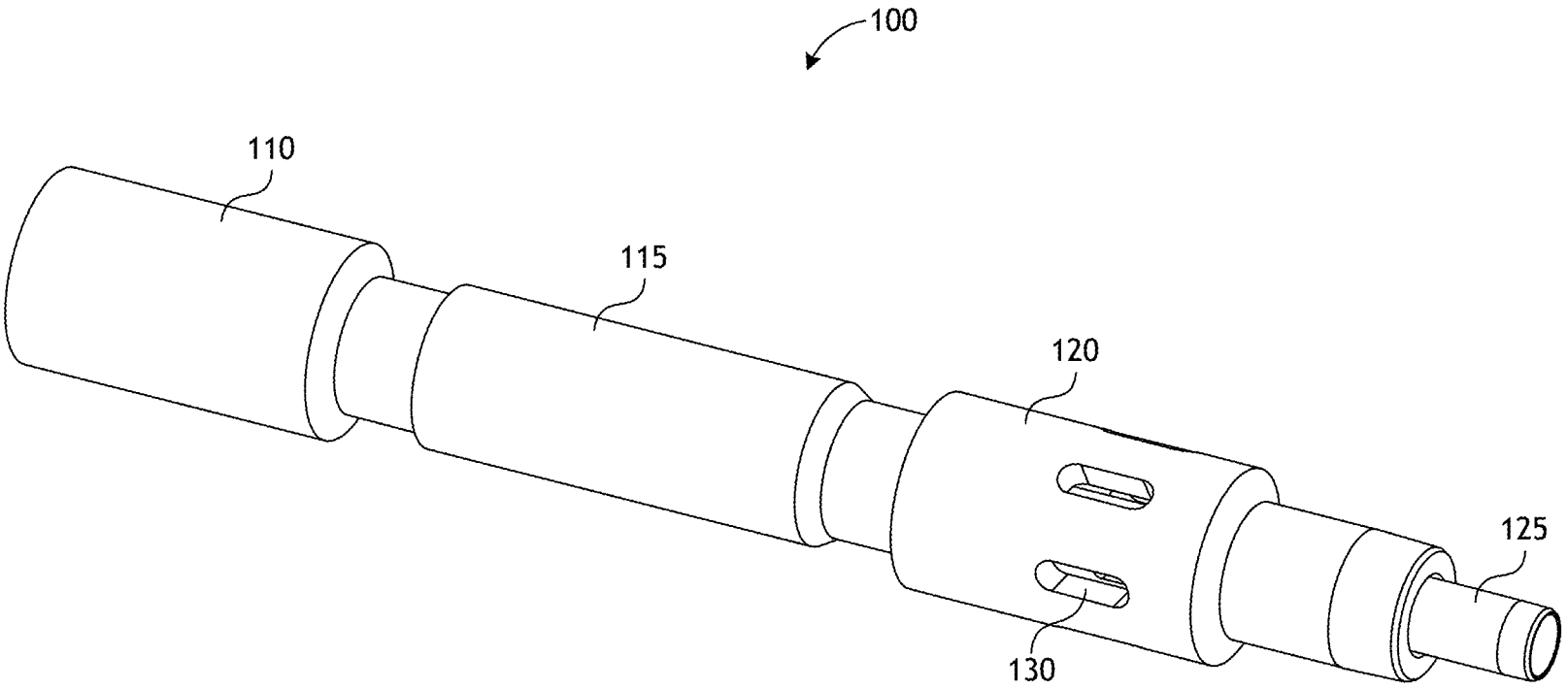
FIG. 1 is a perspective view of a packer bypass assembly including an exemplary embodiment of the present invention.

FIG. 1 is a perspective view of a packer bypass assembly including an exemplary embodiment of the present invention. FIG. 1 illustrates the primary components of packer bypass assembly 100, including check assembly 110, packer 115, annular flow assembly 120, tubing 125, and bypass exit 130. Packer bypass assembly 100 is oriented in a well such that the "upper" (or "first" end) of the assembly is generally located toward check subassembly 110, and the "lower" (or "second" end) is generally located toward tubing 125 in FIG. 1. Furthermore, it should be understood that packer bypass assembly 100 is mounted or installed in a well bore such that check subassembly 110 is positioned in a direction toward the well surface, whereas annular flow subassembly 120 is position in a direction toward the bottom of the well. In other words, check subassembly 110 is oriented above packer 115 and annular flow subassembly 120.

Those skilled in the art will appreciate and understand the function and operation of a packer. In general, a packer is positioned in a well bore (or casing) such that packer 115 seals the annulus between the packer and the walls of the well bore. Once sealed, flow through the well is directed through a primary bore in the packer, where that primary bore is illustrated here as a bore through tubing 125, which extends from a first end of the packer to a second end of the packer, as will be better illustrated by FIG. 3.

Figure 2:
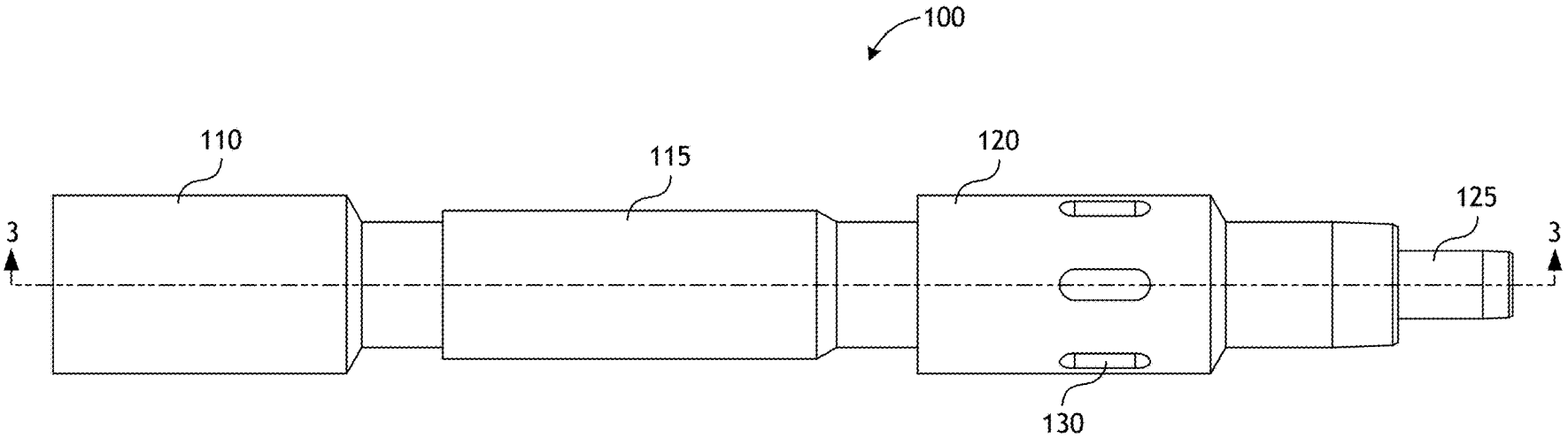
FIG. 2 is a front view of a packer bypass assembly including an exemplary embodiment of the present invention.
Figure 3:
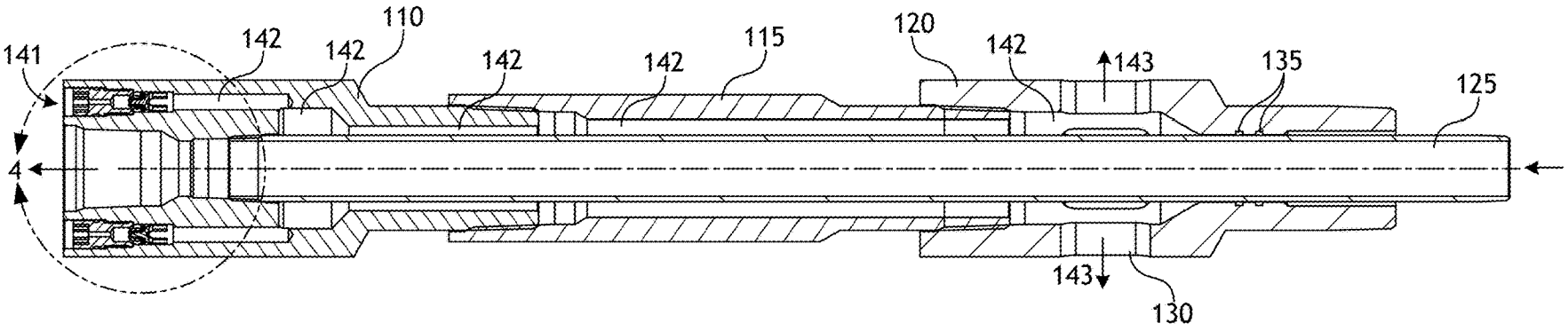
FIG. 3 is a cross-section of the embodiment of FIG. 2 taken along cross-section line 3-3 in FIG. 2.

FIG. 2 is an exemplary front view of packer bypass assembly 100. FIG. 3 is a cross-section of the embodiment of FIG. 2 taken along cross-section line 3-3 in FIG. 2. As shown in the exemplary embodiment of FIG. 3, packer bypass assembly 100 includes a primary bore extending from its first/top end to its second/bottom end. Here, that primary bore is shown as existing in tubing 125 and other portions of packer bypass assembly 100 so that liquids and gases can pass entirely through assembly 100. FIG. 3 shows arrows at the first/top end and the second/bottom end, which illustrate the directional flow through the assembly's primary bore when the well is being produced, i.e., when formation contents are being directed toward the surface of the well. Those skilled in the art will appreciate that flow can be directed in the opposite direction as well such as during a pump-down operation.

Also shown in FIG. 3 is bypass inlet 141, bypass path 142, and bypass outlet 130. These are the primary (but not necessarily the only) components/paths that make up the bypass in packer bypass assembly 100. As directional arrows 141 and 143 show, in one embodiment fluid flow (such as injection gas introduced into the well's annulus) enters the bypass at bypass inlet 141, travels along bypass path 142, exits packer bypass assembly 100 at bypass outlet 130, and then reenters the well's annulus. As explained above, bypassing the packer in this manner enables injection gas to travel down the well's annulus, bypass the packer assembly, and then continue traveling down the well's annuls so that it can be used as injection gas for one or more gas injection valves positioned in the well below the packer. While bypass inlet 141 is shown located at the top end of bypass assembly 100, it can be located on any other position on packer bypass assembly 100 so long as it is positioned above packer 115 and able to receive the contents of the well's annulus. Likewise, while bypass outlet 130 is shown located toward the bottom end of bypass assembly 100, it can be located on any other position on packer bypass assembly 100 so long as it is positioned below packer 115 and able to deliver the bypass contents to the well's annulus. As with the potential bi-directional flow through tubing 125, it should be appreciated that packer assembly 100 can be bypassed in the opposite direction as well such that flow enters "outlet" 130, travels through/along bypass path 142, and then flows out of "inlet" 141.

FIG. 3 also illustrates an embodiment in which packer bypass assembly is modular in design. Specifically this embodiment shows that at least check subassembly 110, packer 115, annular flow subassembly 120, and tubing 125 can be separate components that are connected together to form packer bypass assembly 100. These connections can be one or more of threaded, welded, or otherwise as those skilled in the art will appreciate. One or more o-rings 135 are disposed around tubing 125 below bypass exit 130 to ensure that substantially all of the flow through bypass path 142 is directed out of exit 130 (also labeled bypass outlet 143) when flow is directed from the top of packer bypass assembly 100 toward the bottom of packer bypass assembly 100.

Figure 4:
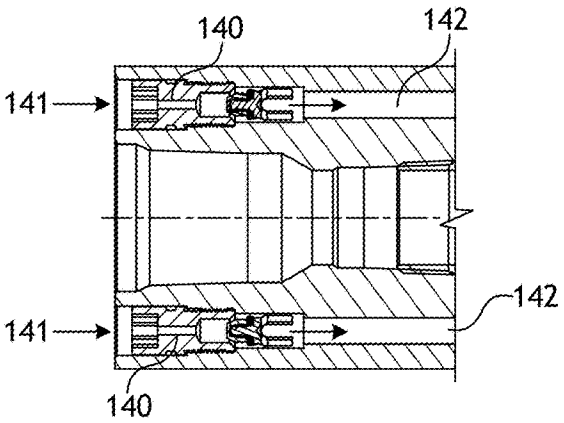
FIG. 4 is an exploded view of Section 4 in FIG. 3.

FIG. 4 is an exploded view of Section 4 in FIG. 3. FIG. 4 better illustrates an exemplary embodiment of a portion of check subassembly 110. Here, bypass path 142 includes check valve 140. Check valve 140 ensures that flow travels in only one direction through the valve and, therefore, through bypass path 142. Those skilled in the art will be familiar with the structure and operation of a one-way valve like those illustrated as check valve 140. Thus, as shown in FIG. 4, flow enters bypass inlet 141, flows through check valve 140, and then onward in the direction of the flow arrows down bypass path 142 toward bypass outlet 143. Again, since check valve 140 is a one-way valve in this embodiment, flow is prevented from flowing in the opposite direction. As explained above, this embodiment can be used so that gas injected from the surface into the annulus between the well bore/casing and the production tubing (including injection mandrels and/or other devices in the tool string) is directed into bypass inlet 141, while production fluids are being produced (to the surface) in tubing 125.

Figure 5:
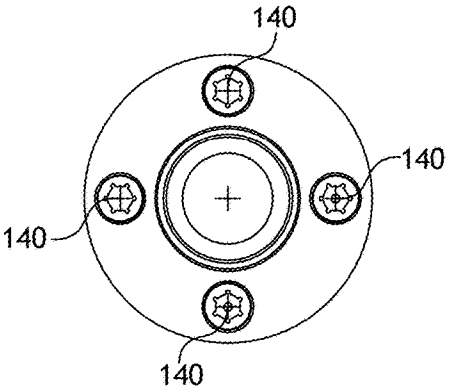
FIG. 5 is a top view of a packer bypass assembly including an exemplary embodiment of the present invention.
Figure 8:
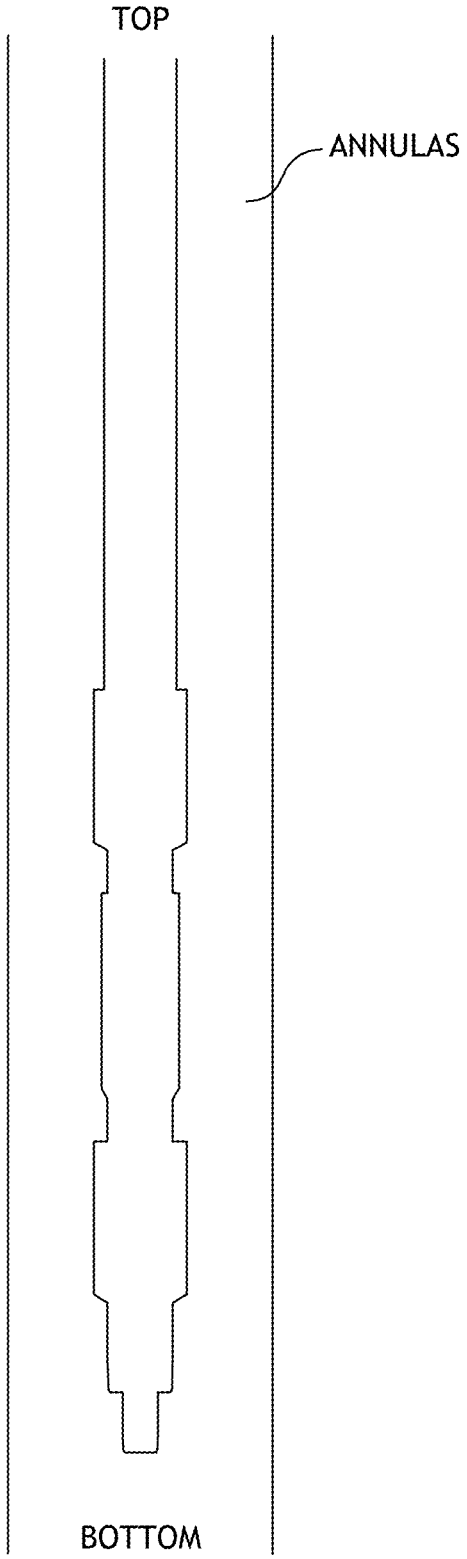
FIG. 8 is a view of a packer bypass assembly deployed in a well.

FIG. 5 is a top view of packer bypass assembly 100 including an exemplary embodiment of the present invention. FIG. 5 better illustrates an exemplary positioning of check valves 140. Specifically, in this embodiment, four such check valves are oriented equidistantly around the top circumference of check assembly 110. As shown in connection with the embodiments of FIGS. 3 and 4, each check valve 140 is positioned in a corresponding portion of each separate bypass path 142. Specifically, each check valve 140 is positioned in a separate bore in an upper portion of check subassembly 110, where each of those separate bores collectively feed a common bore forming the remainder of bypass path 142. These check valves can be installed so that they are removable, such that they can be replaced with other valves that support different flow rates, conditions, pressures, and even different flow directions, i.e., flow opposite the flow direction shown in FIGS. 3 and 4.

Figure 6:
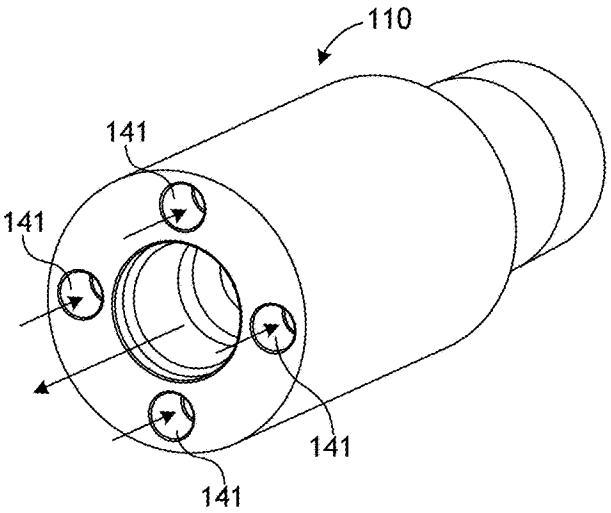
FIG. 6 is a perspective view of a portion of a packer bypass assembly.
Figure 7:
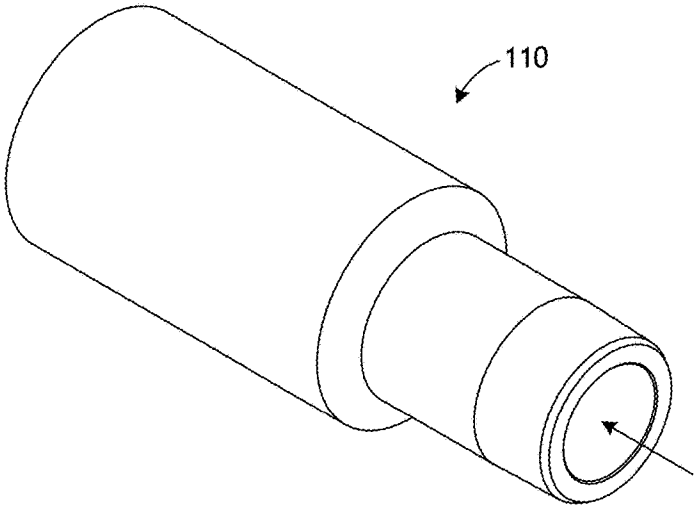
FIG. 7 is a perspective view of a portion of a packer bypass assembly.

FIG. 6 is a perspective view of check subassembly 110 with check valves 140 removed. Exemplary flow directions are shown illustrating flow into bypass inlet 141 and out of the assembly's primary bore. FIG. 7 is another perspective view of check subassembly 110 showing flow into the assembly's primary bore. As explained above, these flow directions could be reversed and in such scenario the flow direction allowed by check valve 140 would likewise be reversed by deploying a different check valve.

Although the invention(s) is/are described herein with reference to specific embodiments, various modifications and changes can be made without departing from the scope of the present invention(s), as set forth in the claims below. Accordingly, the specification and Figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

Accordingly, the protection sought herein is as set forth in the claims below.

The invention claimed is:

1. A packer bypass assembly for connecting to and for use in combination with production tubing in a wellbore, comprising:

a packer for sealing an annulus between the packer bypass assembly and the wellbore such that, when sealed, there is an annulus above the packer and an annulus below the packer;

a primary bore in the packer bypass assembly for passing contents through the packer bypass assembly in a first direction, where the primary bore extends from a first terminal end of the packer bypass assembly to a second end of the packer bypass assembly, and where the first terminal end of the packer bypass assembly is for connecting to the production tubing; and a bypass path, separate from the primary bore, for passing contents from the annulus above the packer through the packer bypass assembly in a second direction, whereby the contents passing in the bypass path enter the bypass path at the first terminal end of the packer bypass assembly and exit the bypass path into the annulus below the packer.

2. The packer bypass assembly of claim 1 wherein the bypass path includes a bypass inlet and a bypass outlet such that the contents passing in the bypass path enter the bypass inlet and exit the bypass path outlet.

3. The packer bypass assembly of claim 2 wherein the bypass path includes a check valve that allows contents to flow in the bypass path only in the second direction.

4. The packer bypass assembly of claim 3 wherein the bypass outlet is located below the packer.

5. The packer bypass assembly of claim 4 wherein the bypass path includes a first section and a second section, where the first section includes a plurality of separate bores and the second section includes a single bore, wherein the second section is located above the packer.

6. The packer bypass assembly of claim 5 wherein each separate bore in the first section of the bypass path includes a check valve.

7. The packer bypass assembly of claim 6 wherein the bypass inlet comprises a plurality of inlets.

8. The packer bypass assembly of claim 7 wherein the bypass outlet comprises a plurality of outlets.

9. The packer bypass assembly of claim 8 wherein the plurality of inlets are positioned at the first terminal end and around at least a portion of the primary bore.

10. The packer bypass assembly of claim 9 wherein the first and second direction are different directions.

11. A packer bypass assembly for connecting to and for use in combination with production tubing in a wellbore, comprising:

a packer for sealing an annulus between the packer bypass assembly and the wellbore;

a primary bore for passing contents through the packer bypass assembly in a first direction; and a bypass path, separate from the primary bore, for passing contents from the annulus through the packer bypass assembly in a second direction, whereby the bypass path includes at least a first section and a second section, where the first section includes a plurality of passageways for receiving contents from the annulus at a first terminal end of the packer bypass assembly, and the second section consists of a single passageway that receives contents from the plurality of passageways, whereby an upper end of the second section is located above the packer, whereby the first terminal end of the packer bypass assembly connects to the production tubing.

12. A packer bypass assembly for connecting to and for use in combination with production tubing in a wellbore, comprising:

a packer for sealing an annulus between the packer bypass assembly and the wellbore;

a primary bore for passing contents through the packer bypass assembly, where the primary bore extends from a first terminal end of the packer bypass assembly to a second portion of the packer bypass assembly, and where the first terminal end of the packer bypass assembly is for connecting to the production tubing; and a bypass path, separate from the primary bore, for passing contents from the annulus through the packer bypass assembly, whereby the contents passing in the bypass path enter the bypass path from the annulus at the first terminal end of the packer bypass assembly and exit the bypass path into the annulus.

13. The packer bypass assembly of claim 12 wherein the bypass path includes a bypass inlet and a bypass outlet such that the contents passing in the bypass path enter the bypass inlet and exit the bypass path outlet.

14. The packer bypass assembly of claim 13 wherein the bypass inlet is located above the packer.

15. The packer bypass assembly of claim 14 wherein the bypass outlet is located below the packer.

16. The packer bypass assembly of claim 15 wherein there is an annulus above the packer and an annulus below the packer when the packer seals the annulus between the packer bypass assembly and the wellbore.

17. The packer bypass assembly of claim 16 wherein contents pass through the primary bore in a first direction.

18. The packer bypass assembly of claim 17 wherein contents pass through the bypass path in a second direction.

19. The packer bypass assembly of claim 18 wherein the bypass path includes a check valve that allows contents to flow in the bypass path only in one direction.

20. The packer bypass assembly of claim 19 wherein the bypass path includes a first section and a second section, where the first section includes a plurality of separate bores and the second section includes a single bore.

21. The packer bypass assembly of claim 20 wherein the second section of the bypass path is located above the packer.

22. The packer bypass assembly of claim 21 wherein each of the plurality of separate bores in the first section of the bypass path includes a check valve.

23. The packer bypass assembly of claim 22 wherein the bypass inlet comprises a plurality of inlets.

24. The packer bypass assembly of claim 23 wherein the bypass outlet comprises a plurality of outlets.

25. The packer bypass assembly of claim 24 wherein the plurality of inlets are positioned at the first terminal end and around at least a portion of the primary bore.

26. The packer bypass assembly of claim 25 wherein the second portion of the packer bypass assembly is at a second terminal end of the packer bypass assembly.

27. A packer bypass assembly for connecting to and for use in combination with production tubing in a wellbore, comprising:

a packer for sealing an annulus between the packer bypass assembly and the wellbore such that, when sealed, there is an annulus above the packer and an annulus below the packer;

a primary bore for passing contents through the packer bypass assembly in a first direction, where the primary bore extends from a first terminal end of the packer bypass assembly to a second end of the packer bypass assembly;

a bypass path, separate from the primary bore, for passing contents from the annulus above the packer through the packer bypass assembly in a second direction, whereby the contents passing in the bypass path enter the bypass path at the first terminal end of the packer bypass assembly and exit the bypass path into the annulus below the packer, wherein the bypass path includes a bypass inlet and a bypass outlet such that the contents passing in the bypass path enter the bypass inlet and exit the bypass path outlet, and wherein the bypass path includes a check valve, located entirely between the first terminal end of the packer bypass assembly and the second end of the packer bypass assembly, that allows contents to flow in the bypass path only in the second direction.

28. The packer bypass assembly of claim 27 wherein the bypass outlet is located below the packer.

29. The packer bypass assembly of claim 28 wherein the bypass path includes a first section and a second section, where the first section includes a plurality of separate bores and the second section includes a single bore, wherein the second section is located above the packer.

30. The packer bypass assembly of claim 29 wherein each separate bore in the first section of the bypass path includes a check valve.

31. The packer bypass assembly of claim 30 wherein the bypass inlet comprises a plurality of inlets.

32. The packer bypass assembly of claim 31 wherein the bypass outlet comprises a plurality of outlets.

33. The packer bypass assembly of claim 32 wherein the plurality of inlets are positioned at the first terminal end and around at least a portion of the primary bore.

34. The packer bypass assembly of claim 33 wherein the first and second direction are different directions.

* * * * *